US008133353B2

(12) United States Patent
Blanz et al.

(10) Patent No.: US 8,133,353 B2
(45) Date of Patent: Mar. 13, 2012

(54) CREPED PAPER PRODUCT

(75) Inventors: John James Blanz, Mosinee, WI (US); Thomas Brod, Mosinee, WI (US); Emerson S. Brooks, Jay, ME (US)

(73) Assignee: Wausau Paper Corp., Mosinee, WI (US)

( * ) Notice: Subject to any disclaimer, the term of this patent is extended or adjusted under 35 U.S.C. 154(b) by 739 days.

(21) Appl. No.: 11/080,346

(22) Filed: Mar. 15, 2005

(65) Prior Publication Data

US 2006/0207735 A1 Sep. 21, 2006

(51) Int. Cl.

| | |
|---|---|
| ***B31F 1/12*** | (2006.01) |
| ***D21H 13/24*** | (2006.01) |
| ***D21F 11/00*** | (2006.01) |
| ***B32B 7/12*** | (2006.01) |
| ***B32B 37/26*** | (2006.01) |

(52) U.S. Cl. ..... 162/111; 162/118; 162/135; 162/146; 162/169; 428/153; 428/34.2; 428/32.81; 428/343; 428/352; 428/355 BL; 156/183; 264/282

(58) Field of Classification Search ..... 162/109, 162/111–113, 118, 141, 146, 145, 152, 156, 162/157.1–157.7, 135–137, 158, 197, 204–207; 428/152–153, 172, 343, 352, 355 BL, 906, 428/32.81, 41.8, 202; 156/183; 264/282–283
See application file for complete search history.

(56) References Cited

U.S. PATENT DOCUMENTS

| | | | | |
|---|---|---|---|---|
| 2,941,661 A | | 6/1960 | Picard et al. | |
| 2,954,868 A | * | 10/1960 | Swedish, Jr. et al. | 428/153 |
| 2,996,425 A | * | 8/1961 | Hamilton | 162/113 |
| 3,026,217 A | * | 3/1962 | Hechtman et al. | 162/169 |
| 3,124,558 A | * | 3/1964 | Stucker et al. | 428/153 |
| 3,154,430 A | * | 10/1964 | Goodloe et al. | 162/168.1 |
| 3,156,581 A | * | 11/1964 | Miller et al. | 428/343 |
| 3,489,643 A | * | 1/1970 | Hoffman | 162/157.3 |
| 3,503,495 A | * | 3/1970 | Gustafson et al. | 428/153 |
| 3,879,257 A | | 4/1975 | Gentile et al. | |
| 4,529,481 A | * | 7/1985 | Yoshida et al. | 162/146 |
| 4,637,859 A | * | 1/1987 | Trokhan | 162/109 |
| 4,654,254 A | | 3/1987 | Gerry et al. | |
| 4,834,838 A | | 5/1989 | Klowak | |

(Continued)

FOREIGN PATENT DOCUMENTS

EP 0 411 752 A1 2/1991

(Continued)

*Primary Examiner* — Jose A Fortuna
(74) *Attorney, Agent, or Firm* — Merchant Gould, P.C.

(57) ABSTRACT

A creped paper product is provided according to the invention. The creped paper product comprises a result of creping a web of fibers comprising synthetic fibers to provide a creped paper product having a stretch of at least 3% in the machine direction according to TAPPI test T494. The web of fibers can include about 0.5 wt. % to 100 wt. % synthetic fibers based on the total weight of the fibers. In addition, the web of fibers can contain about 0.5 wt. % to about 10 wt. % of synthetic fibers and about 90 wt. % to about 99.5 wt. % of cellulosic fibers. When the web of fiber includes a mixture of synthetic fibers and cellulosic fibers, the creped paper product can be provided having a tear strength in the machine direction according to TAPPI test T494 at least 10% greater than an otherwise identical creped paper product that does not contain synthetic fibers. A method for forming a creped paper product is provided according to the invention.

22 Claims, 3 Drawing Sheets

U.S. PATENT DOCUMENTS

| | | | | |
|---|---|---|---|---|
| 4,849,278 | A * | 7/1989 | Stokes | 428/153 |
| 5,223,092 | A | 6/1993 | Grinnell et al. | |
| 5,223,093 | A | 6/1993 | Klowak | |
| 5,223,095 | A * | 6/1993 | Kinsley, Jr. | 162/146 |
| 5,318,670 | A * | 6/1994 | Link et al. | 162/206 |
| 5,385,783 | A * | 1/1995 | Patel et al. | 428/353 |
| 5,387,319 | A * | 2/1995 | Mora et al. | 162/146 |
| 5,496,601 | A * | 3/1996 | Schurb | 428/41.5 |
| 5,674,590 | A | 10/1997 | Anderson et al. | |
| 5,688,523 | A | 11/1997 | Garbe et al. | |
| 5,690,787 | A | 11/1997 | Hultman et al. | |
| 6,048,806 | A | 4/2000 | Deeb et al. | |
| 6,146,499 | A * | 11/2000 | Lin et al. | 162/197 |
| 6,187,140 | B1 | 2/2001 | Anderson et al. | |
| 6,193,838 | B1 * | 2/2001 | Oriaran et al. | 162/112 |
| 6,277,241 | B1 | 8/2001 | Merker et al. | |
| 6,458,244 | B1 * | 10/2002 | Wang et al. | 162/146 |
| 6,637,697 | B1 | 10/2003 | Wienberg | |
| 6,774,063 | B2 | 8/2004 | Bouchette et al. | |
| 6,808,597 | B2 | 10/2004 | Allen | |
| 6,827,819 | B2 | 12/2004 | Dwiggins et al. | |
| 6,828,008 | B2 | 12/2004 | Gruber | |
| 6,838,154 | B1 | 1/2005 | Varona et al. | |
| 7,156,953 | B2 * | 1/2007 | Tirimacco et al. | 162/112 |
| 7,189,308 | B2 * | 3/2007 | Feit et al. | 162/180 |
| 2001/0008180 | A1 | 7/2001 | Anderson et al. | |
| 2003/0051838 | A1 * | 3/2003 | Wang et al. | 162/146 |
| 2004/0115431 | A1 * | 6/2004 | Chen et al. | 428/373 |
| 2004/0238135 | A1 * | 12/2004 | Edwards et al. | 162/111 |
| 2004/0241435 | A1 * | 12/2004 | Grittner et al. | 428/354 |
| 2004/0250969 | A1 * | 12/2004 | Luu et al. | 162/123 |
| 2005/0247416 | A1 * | 11/2005 | Forry et al. | 162/109 |
| 2005/0258576 | A1 * | 11/2005 | Forry et al. | 264/517 |
| 2006/0042767 | A1 * | 3/2006 | Bhat et al. | 162/117 |
| 2006/0086472 | A1 * | 4/2006 | Hermans et al. | 162/111 |
| 2006/0130988 | A1 * | 6/2006 | Hermans et al. | 162/123 |
| 2006/0207735 | A1 * | 9/2006 | Blanz et al. | 162/111 |
| 2008/0076696 | A1 * | 3/2008 | Uitenbrock et al. | 510/515 |

FOREIGN PATENT DOCUMENTS

| | | | |
|---|---|---|---|
| EP | 454104 | A1 * | 10/1991 |
| EP | 1703017 | A1 * | 9/2006 |
| WO | WO 89/01074 | | 2/1989 |

* cited by examiner

CREPED PAPER PRODUCT

FIELD OF THE INVENTION

The invention relates to a creped paper product and a method for manufacturing a creped paper product. In particular, the invention relates to a creped paper product including synthetic fibers for enhanced tear strength.

BACKGROUND OF THE INVENTION

Tape products provided in roll form, such as masking tape, typically include a base sheet of fibrous materials impregnated with a latex composition, and an adhesive is applied to one side and a release coating applied to the opposite side. The coated product is then wound and slit into rolls. In some applications, it is desirable for tape to be stretchable. For example, it is desirable for masking tapes to be stretchable as it allows it to conform well to curved or irregular surfaces.

Creping is a technique used to impart a degree of stretchability to paper. For an example of creping being used to impart stretchability to masking tape, see U.S. Pat. No. 2,941,661 to Picard et al. Creping typically involves impacting paper against a device, such as a blade, resulting in crinkling and at least partial disruption of inter-fiber bonding.

SUMMARY OF THE INVENTION

Figure 1:
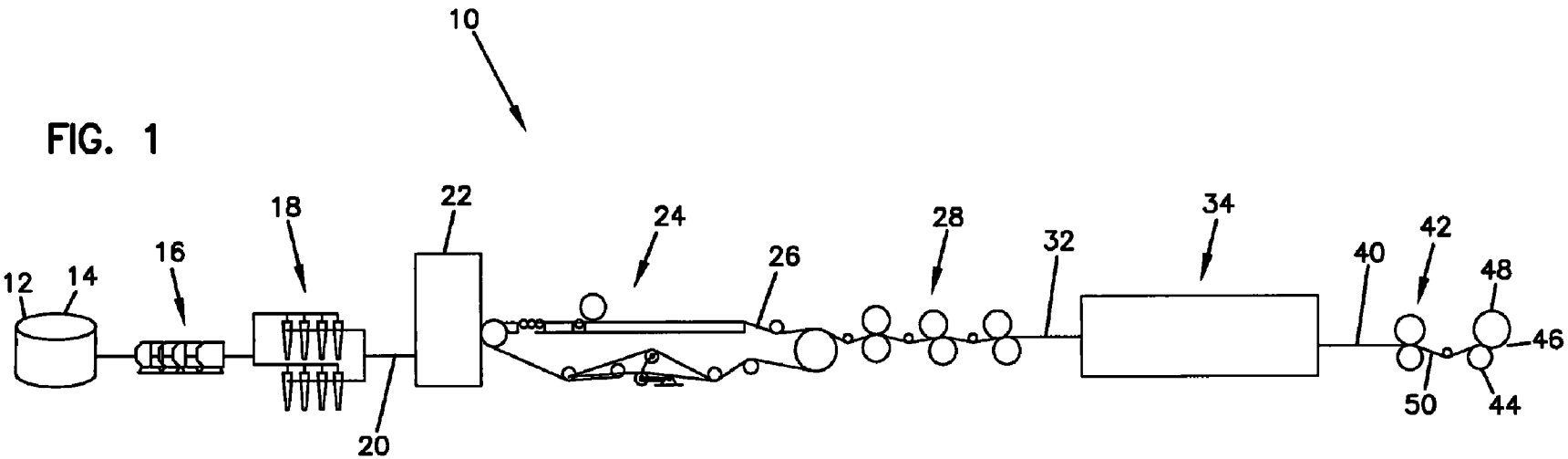
FIG. 1 is a schematic diagram of an exemplary process for manufacturing a creped paper product according to the invention.

A creped paper product is provided according to the invention. The creped paper product comprises a result of creping a web of fibers comprising synthetic fibers to provide a creped paper product having a stretch of at least 3% in the machine direction according to TAPPI test T494. The web of fibers can include a sufficient amount of synthetic fiber to increase tear strength. For example, the web of fibers can include about 0.5 wt. % to 100 wt. % synthetic fibers based on the total weight of the fibers. The remaining fiber component, if present, can include cellulosic fibers. The web of fibers can contain about 0.5 wt. % to about 10 wt. % of synthetic fibers and about 90 wt. % to about 99.5 wt. % of cellulosic fibers. When the web of fiber includes a mixture of synthetic fibers and cellulosic fibers, the creped paper product can be provided having a tear strength in the machine direction according to TAPPI test T494 at least 10% greater than an otherwise identical creped paper product that does not contain synthetic fibers.

A method for forming a creped paper product is provided according to the invention. The method includes creping a web of fibers to provide a creped paper product having a stretch of at least 3% in the machine direction according to TAPPI test T494. The web of fibers can include a sufficient amount of synthetic fiber to increase tear strength. For example, the web of fibers can include about 0.5 wt. % to 100 wt. % synthetic fibers based on the total weight of the fibers. The remaining fiber component, if present, can include cellulosic fibers. In addition, the web of fibers can contain about 0.5 wt. % to about 10 wt. % of synthetic fibers and about 90 wt. % to about 99.5 wt. % of cellulosic fibers. When the web of fiber includes a mixture of synthetic fibers and cellulosic fibers, the creped paper product can be provided having a tear strength in the machine direction according to TAPPI test T494 at least 10% greater than an otherwise identical creped paper product that does not contain synthetic fibers.

DETAILED DESCRIPTION

Creped paper can be obtained by subjecting a web of fibers to a creping technique or process. In general, creping technique involves impacting the web of fibers to create crinkles or crepe lines. Creping tends to have the general effect of increasing stretch. The creped paper product can be referred to more simply as the "paper product" or the "creped paper."

The creped paper product can refer to a single layer structure of a web of fibers that has been creped, or to a laminate containing at least one layer of a web of fibers that have been creped. In the case of a laminate, an additional layer can include, for example, a release layer, an adhesive layer, or a release layer and an adhesive layer. The release layer and the adhesive layer can be provided on opposing sides of the creped paper product so that the creped paper product can form, for example, a tape that can be provided in the form of a roll. The web of fibers can be treated with various paper treatment additives such as a latex.

The creped paper product can be used in various applications where it is desired to provide a creped paper product having desired stretch and tear strength properties. An exemplary product formed from a creped paper product includes tape such as masking tape. Masking tapes are often applied over a surface to protect the surface from paints, stains, varnishes, etc. that may be applied near the masking tape. Additional products that may benefit from a creped paper product having desired flexibility and tear strength properties include clothing such as medical garments, carpet seaming tape, sewing tape, and book binding.

The phrase "machine direction" in reference to the paper product refers to the lengthwise (continuous) direction of the paper product. The machine direction can be referred to as the continuous direction and is the direction along which the paper product travels as it is manufactured. In the case of a roll of tape, the machine direction or continuous direction refers to the direction along which the tape is rolled or unrolled. The phrase "cross direction" or "transverse direction" is the width or direction perpendicular to the continuous direction, of the paper product. By way of example, for a roll of tape having a width of 1 inch and a length of 100 feet, the machine direction refers to the length of 100 feet and the transverse direction refers to the width of 1 inch. It should be understood that the paper product can be provided with any dimension, as desired.

Manufacture of the Paper Product

Referring to FIG. 1, a process for making a creped paper product according to the invention is shown at reference numeral 10. It should be understood that FIG. 1 is an exemplary schematic diagram and includes many of the operations carried out in commercial paper making facilities. The equipment used in a particular operation may vary from facility to facility and the sequence of many operations performed can be altered. It is expected that many of the same general operations will be present in many facilities for making creped paper.

A starting material 12 can be referred to as pulp 14 and can be processed through a refining operation 16 and through a cleaning operation 18 to provide cleansed pulp 20. The cleansed pulp 20 can be applied through a head box 22 onto a papermaking machine 24 such as a fourdrinier machine to create a web of fibers 26. The papermaking machine 24 can create the web of fibers 26 by a wet laid technique. The side of the web of fibers 26 facing down on the papermaking machine 24 can be referred to as the "wire side," and the side of the web of fibers 26 facing up on the papermaking machine 24 can be referred to as the "felt side." Additives added at or before the head box 22 can be referred to as "wet end chemistry." The web of fibers 26 can be processed through a wet press to remove water and to provide an intermediate paper substrate 32. If desired, a dryer can be provided to reduce the water content of the intermediate paper substrate 32.

The intermediate paper substrate 32 can be subjected to creping at a creping press 34. The desired water content of the intermediate paper substrate 32 prior to creping may be selected depending upon the particular creping technique utilized. The intermediate paper substrate 32 can be creped in a wet state or in a dry state. For example, it may be desirable to reduce the water content of the intermediate paper substrate 32 to less than about 80 wt. % prior to creping, and it may be desirable to reduce the water content of the intermediate paper substrate 32 to less than about 60 wt. % prior to creping. One would understand how dryers could be used to reduce water content to a desired level for creping.

Various techniques for creping are available. In general, creping involves the impacting of the intermediate paper substrate 32 against a device, such as a blade, resulting in crinkling and at least a partial disruption of inter-fiber bonding.

The creping can be performed as part of the paper making process ("on machine") or as part of a procedure separate from the paper making process ("off machine"). As shown in FIG. 1, the creping is performed "on machine." The substrate recovered from the creping press 34 can be referred to as the rough creped paper substrate 40. The rough creped paper substrate 40 can be further processed as desired. For example, the rough creped paper substrate 40 can be further dried, treated with a composition such as a latex, or a combination of both. Additives added to a paper substrate using a size press can be referred to as "size press chemistry." It is known that additives can be incorporated into paper using, for example, wet end chemistry, size press chemistry, or a combination of wet end chemistry and size press chemistry.

The rough creped paper 40 having the desired water content can pass through a machine calender 42 to provide a finished creped paper product 50. The finished creped paper product 50 can be referred to as the creped paper product and can be sent to a winder 44 and taken up on a roll 46 as roll stock 48. The finished creped paper product 50 can be sold as roll stock 48 or further processed for additional processing such as that described in FIGS. 2 and 3.

Figure 2:
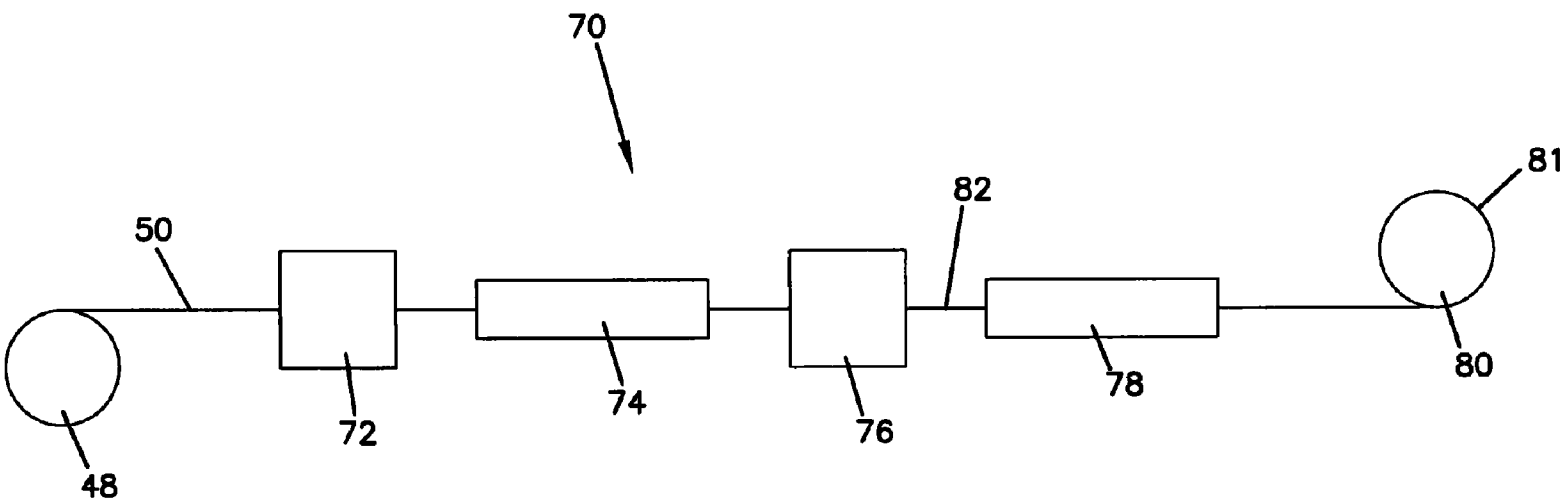
FIG. 2 is a schematic diagram of an exemplary process for treating a creped paper product with latex and applying a release coating.

Referring now to FIG. 2, a schematic view of an exemplary process for application of latex and a release coating to a creped paper substrate is shown at reference number 70. The finished creped paper product 50 is taken off the roll stock 48 and treated with a latex composition at a bath 72. Many different latex compositions are known in the art and can be used to treat the creped paper product. The creped paper product 50 can be fed to a dryer 74, such as an air floatation dryer. The creped paper substrate 50 can be fed to a coating station 76 that applies a release layer composition onto one side of the creped paper substrate 50 forming an intermediate tape product 82. Many different release layer compositions are known in the art. An example of a suitable release layer composition is disclosed in U.S. Pat. No. 2,941,661 (Picard et al.). One of skill in the art will appreciate that many different pieces of equipment may be used to apply the release layer including roll coaters, gate-roll coaters, blade coaters, metering size presses, bill blade coaters, sprayers, and the like. After the release layer is applied, the intermediate tape product 82 can be fed to another dryer 78, such as another air floatation dryer. The dried intermediate tape product 82 can be wound onto a roll 80 as roll stock 81.

Figure 3:
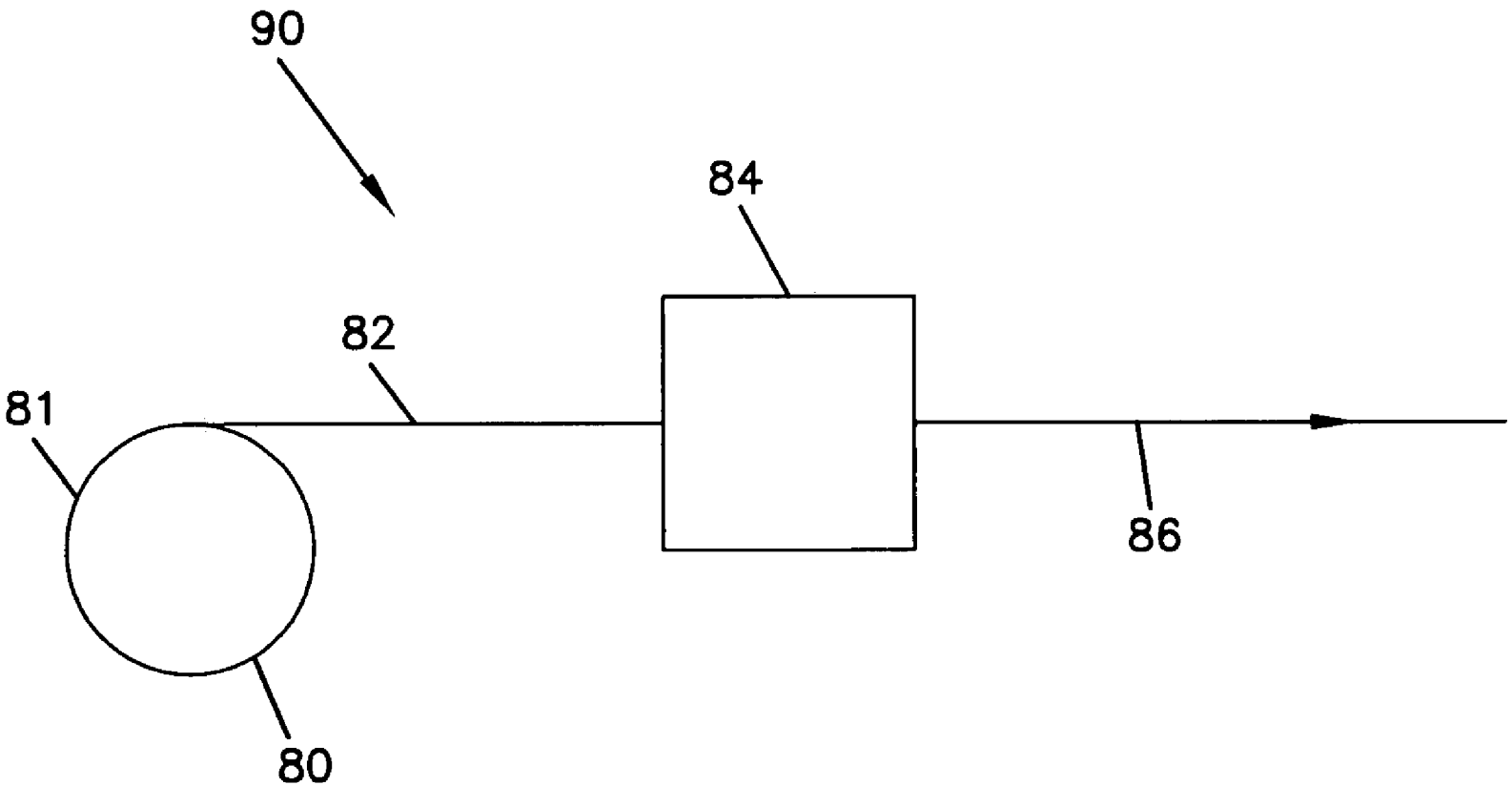
FIG. 3 is a schematic diagram of an exemplary process for applying an adhesive composition to a latex treated creped paper product.

Referring now to FIG. 3, a schematic view of an exemplary process for applying an adhesive composition to an intermediate tape product 82 is shown at reference number 90. The intermediate tape product 82 is taken off the roll stock 81 and fed to an adhesive coating station 84. An adhesive layer is applied to the intermediate tape product 82 forming a finished tape product 86. The finished tape product may pass through a dryer (not shown) before continuing on for further processing including slitting and winding and the formation of end user rolls.

It should be understood that FIGS. 2 and 3 are exemplary schematic diagrams and include many of the operations carried out in converting the finished creped paper product 50 into a tape product such as a masking tape. The techniques of FIGS. 2 and 3 can be combined if it is desirable to avoid rolling the intermediate tape product 82 into the roll stock 81. Similarly, the techniques of FIG. 2 or 3 or both can be combined with the technique of FIG. 1 if it is desirable to avoid rolling the finished creped paper product 50 into the roll stock 48.

Synthetic Fibers

The Applicants have found that the tear strength of a creped paper product can be increased by the addition of synthetic fiber to the pulp used to form the web of fibers. Incorporating synthetic fibers into a web of fibers can increase the tear strength of creped paper products. The increase in tear strength can be measured in comparison to an otherwise identical creped paper product except not containing the synthetic fiber. Accordingly, the synthetic fiber is provided in the creped paper product in an amount sufficient to increase the tear strength relative to the creped paper product without the synthetic fiber.

The increase in tear strength can be provided for creped paper products that are not latex treated and for creped paper products that are latex treated. In general, latex treatment refers to the application of a latex composition to the web of fibers. A latex composition refers to an aqueous polymer composition that can be provided in the form of an emulsion, a dispersion, or a combination of an emulsion and a dispersion.

The web of fibers can include a sufficient amount of the synthetic fiber so that the dry tear strength of the resulting crepe paper product, as measured in the machine direction according to TAPPI test T414, is greater than an otherwise identical creped paper product that does not contain synthetic fibers. It should be understood that the reference to "an otherwise identical creped paper product that does not contain synthetic fibers" refers to a creped paper product prepared by the same technique except that the web of fibers includes non-synthetic fibers in place of the synthetic fibers. It is generally expected that the non-synthetic fibers will be the same type of fibers as the remaining non-synthetic fibers provided in the web of fibers. The dry tear strength of a creped paper product containing synthetic fibers, as measured in the machine direction according to TAPPI test T414, can be at least 10% greater than an otherwise identical creped paper product that does not contain synthetic fibers. The dry tear strength of a creped paper product containing synthetic fibers, as measured in the machine direction according to TAPPI test T414, can be at least 20% greater than an otherwise identical creped paper product that does not contain synthetic fibers.

This improvement can be seen in both creped paper products that have and have not been treated with a latex composition.

Treating a creped paper product with a latex composition can result in a decrease in dry tear strength. The Applicants have found that incorporating an amount of synthetic fiber into the web of fibers can increase tear strength of a creped paper product formed from a web of fibers that is latex treated. Dry tear strength of a creped paper product treated with a latex, as measured in the machine direction according to TAPPI test T414, can be at least 10% greater than an otherwise identical creped paper product that does not contain synthetic fibers. The increase in tear strength of a creped paper product treated with a latex can be at least about 20%, at least about 30%, and at least about 40% greater than an otherwise identical creped paper product that does not contain the synthetic fiber.

Creped paper containing synthetic fiber as at least part of the web of fibers can have an increase in dry tear strength, as measured in the cross direction according to TAPPI test T414, that is greater than an otherwise identical creped paper product that does not contain the synthetic fiber. The increase in dry tear strength in the cross direction can be at least 10% greater than an otherwise identical creped paper product that does not contain the synthetic fibers. The dry tear strength can be greater than 20%, greater than 30%, and greater than 40% than an otherwise identical creped paper product that does not contain the synthetic fibers. The increase in tear strength in the cross direction can be seen for both creped paper product that does not contain latex treatment and creped paper product that does contain latex treatment.

Various synthetic fibers can be added to a web of fibers to increase tear strength. The synthetic fibers can be selected so that they process desirably in the paper making process. Exemplary synthetic fibers include polyester, polypropylene, polyethylene, polyolefin, rayon, nylon, acrylic, glass, and polyvinyl alcohol. An exemplary synthetic fiber that can be used is polyester. The synthetic fibers can be provided as multicomponent fibers such as bicomponent fibers having different polymers forming part of the same fiber. An exemplary bicomponent fiber includes a core and sheath fiber. An exemplary core and sheath fiber includes a fiber having a polyester core and a polyethylene sheath. Various additional forms of biocomponent fibers include structures that can be characterized as concentric sheath/core, eccentric sheath/core, side-by-side, pie wedge, hollow pie wedge, islands/sea, and three islands. The various forms may provide advantages for particular applications.

The synthetic fiber can be provided in various forms so that the resulting paper product has desired properties. For example, the synthetic fiber can be provided as crimped or non-crimped. Exemplary forms of crimped fiber include spiral crimped, two-dimensional crimped, coil springs, and helical fibers. The fiber can be provided having various cross sectional shapes such as solid round, hollow, trilobal, and ribbon. The various cross sections may provide advantages for particular applications.

The unit "denier" is a measure of mass of fiber per length of fiber. For example, denier is often expressed as grams per 9,000 meters. Denier is often used to characterize the fineness of a fiber. Fibers characterized as having a relatively low denier are generally considered to be fairly fine while fibers characterized as having a higher denier are often referred to as thicker fibers. If the fibers have a denier that is too low, it is expected that the web of fibers may not achieve a desired increase in tear strength. If the denier is too high, it may be difficult for the synthetic fibers to interact and entangle with the web of fibers. The selection of the appropriate denier for a fiber depends on a number of factors including the chemistry and properties of the polymer. By way of example, it is expected that the synthetic fibers can be provided having a size of at least about 0.1 denier and the synthetic fibers can be provided having a size of less than about 25 denier. In addition, the synthetic fibers can be provided having a size of about 0.5 denier to about 10 denier, and can have a size of about 1 denier to about 5 denier.

The length of the synthetic fiber can be selected to provide the desired level of tear strength increase as a result of the incorporation of the synthetic fiber. If the synthetic fibers have a length that is too small, it is expected that there may not be a desired increase in tear strength. If the synthetic fibers have a length that is too large, it may be difficult to process the synthetic fibers on conventional paper making equipment that utilize a wet laid technique. Longer fibers may be applied using other techniques for forming a non-woven including needle punching, hydroentangling, stitch bonding, or carding. For example, in a wet laid application, the synthetic fibers can have an average length of at least about 1 mm to provide an increase in tear strength, and can be provided having an average length of less than about 8 mm to avoid processing difficulties resulting from the length of the fiber. The synthetic fiber can be provided having an average length of about 2 mm to about 7 mm, and can have an average length of about 3 mm to about 6 mm. If the manufacturing equipment can handle longer fibers, it may be desirable to utilize synthetic fibers having a length of up to about 100 mm. In addition, it may be desirable to utilize synthetic fibers having a length of about 1 mm to about 75 mm.

The fibers used to form the web of fibers can contain an amount of synthetic fibers to provide enhanced or increased tear strength compared with an otherwise identical web of fibers but not containing the synthetic fibers. In general, if there is too little amount of synthetic fibers, there may not be a desired increase in tear strength. The amount of synthetic fiber to achieve a desired increase in tear strength may depend on certain properties of the synthetic fiber including denier, length, and the polymer. For example, the web of fibers can contain at least about 0.5 wt. % synthetic fibers, based upon the total weight of the fiber. The amount of synthetic fibers can be at least about 1 wt. % and can be at least about 1.5 wt. %. It is expected that all of the fiber can be provided as synthetic fiber. That is, 100% of the web of fibers can be provided as synthetic fibers. In addition, it is expected that tear strength will increase with the increasing percentage of synthetic fiber. A disadvantage with large amounts of synthetic fiber is the cost associated with the synthetic fiber. Accordingly, it may be desirable from an economic perspective to increase the amount of pulp or cellulosic fiber and decrease the amount of synthetic fiber. The Applicants have found that above levels of synthetic fiber of about 10 wt. %, based on the total weight of the fiber, the increase in tear strength may not be as great. Accordingly, it may be desirable to provide the level of synthetic fiber at less than about 10 wt. %. In addition, it may be desirable to provide the amount of synthetic fiber as less than about 6 wt. % based on the total weight of the fiber. In addition, it may be desirable to provide the synthetic fiber in an amount of about 2 wt. % to about 5 wt. % based on the total weight of the fiber.

Creping

One of skill in the art will appreciate that many different methods may be used to crepe paper. An exemplary creping press can include a first crepe press roll made of a soft material and a second crepe press roll made of a more rigid material such as steel. The web of fibers can travel between the rolls and adhere to and follow the second crepe press roll. The web of fibers can be creped off the second crepe press roll using a doctor blade (or creping blade) to produce a rough creped paper substrate.

The web of fibers that is creped can be characterized as wet or dry. Creping a wet web of fibers can be referred to as wet creping, and creping a dry web of fibers can be referred to as dry creping. In the case of wet creping, it can be desirable for the web of fibers to have a water content of about 20 wt. % to about 65 wt. %. In addition, the web of fibers can have a moisture content of about 35 wt. % to about 60 wt. %. Dry creping is generally characterized as creping a web of fibers having a moisture content of less than about 20 wt. %.

Creping is provided to impart a degree of stretchability to a paper substrate. Stretching properties may be measured according to TAPPI test T494. The web of fibers can be creped to provide a creped paper product having a stretch of at least about 3% in the machine direction (MD) according to TAPPI test T494. Although the web of fibers can be creped to provide a crepe paper product having the desired stretchability, it is generally expected that the stretchability will be less than about 30% in the machine direction (MD) according to TAPPI test T494. The creped paper product can be provided having a stretch of about 3% to about 15% in the machine direction (MD) according to TAPPI test T494, and ca be provided having a stretch of about 8% to about 12% in the machine direction according to TAPPI test T494.

The creping process results in the formation of creping lines on the rough creped paper substrate. In general, creped paper having a relatively low number of lines per lineal inch can be associated with heavy papers that are generally more abrasive and rougher compared with creped paper having more crepe lines per lineal inch to produce lighter papers that are finer and smoother. It should be understood that this is just a general characterization and heavy papers can include a higher number of crepe lines per lineal inch than lighter papers. When providing more abrasive and rougher creped paper, the creping process can provide about 5 to about 15 crepe lines per lineal inch. For finer and smoother creped paper products, it may be desirable to provide at least about 15 crepe lines per lineal inch. It is expected that the number of crepe lines can be as large as desired for a particular application. For example, it may be desirable to provide creped paper having in excess of 100 crepe lines per lineal inch. For example, it may be desirable to provide creped paper having up to about 200 crepe lines per lineal inch. For masking tape applications where it is generally desirable to provide a fine and smooth paper product that does not wear and tear on a user's thumb and finger, the creped paper product can include crepe lines of about 15 to about 100 per lineal inch, about 17 to about 50 per lineal inch, and about 20 to about 30 per lineal inch.

Wet End Chemistry

Wet end additives can be provided for imparting strength, opacity, color, etc. Exemplary wet strength additives include urea-formaldehyde, melamine-formaldehyde, and polyamide. Exemplary dry strength additives include starches (such as cationic potato starch). One of skill in the art will appreciate that many different types of starches can be used such as corn starch, rice starch, tapioca starch, and wheat starch. Exemplary colorants include dyes, pigments, and opacifying color additives. Exemplary opacifying additives include kaolin clays, titanium dioxide, and calcium carbonate. One of skill in the art will appreciate that these components may be added in many different ways including being added as a part of a batch control process or being added through a metering system for continuous operations. Other components, such as defoaming agents, pitch dispersants, plasticizers (urea), etc. may also be added prior to the head box. Acid alum (aluminum sulfate and sulfuric acid) may be added prior to the head box. Acid alum can serve various purposes including drainage enhancement, rosin sizing, part of certain retention aid programs, dye fixation, cationic source, acidic buffer. Sizing agents that increase water hold-out are also sometimes added as a part of wet end chemistry.

Bulking agents can be added as a part of wet-end chemistry. However, while not intending to be bound by theory, it is believed that certain types of bulking agents may result in reduced dry tear strength of the finished creped paper product. In an embodiment, the creped paper product of the invention includes less than 14% by weight of bulking agents. In an embodiment, the creped paper product of the invention includes less than 10% by weight of bulking agents. In an embodiment, the creped paper product of the invention includes less than 5% by weight of bulking agents. In an embodiment, the creped paper product of the invention includes about 0.0% by weight of bulking agents.

Size Press Chemistry

Size press additives can be provided for sizing, strength, coloring, to close up the surface of the sheet (film formers such as sodium alginate), to fill in the surface of the sheet, for water resistance, and/or oil resistance. Exemplary water resistance additives include alkyl ketene dimmer (AKD), styrene maleic anhydride (SMA), and waxes. Exemplary oil resistance additives include fluorochemicals. Exemplary fillers include kaolin clays, titanium dioxide, and calcium carbonate. Plasticizers may also be added at the size press 50. Plasticizers include humectants and can function to keep paper soft and make it less likely that the paper will fracture. Suitable plasticizers include urea, nitrates, glycerine, and saccharides.

It will be appreciated that there are alternative techniques for applying components to a paper product besides a size press. Other application techniques including roll coaters, gate-roll coaters, blade coaters, metering size presses, bill blade coater, and sprayers may also be used to apply components to the rough creped paper substrate as a part of the paper making machine ("on machine") or as a part of a procedure entirely separate from the paper making machine ("off machine"). By way of example, otherwise finished paper may be unrolled and then fed through a separate machine to apply a specific component.

Latexes

Latexes can be applied to a web of fibers to enhance delamination resistance, barrier, or stretch properties. A latex composition can be used to hold the web of fibers together so that the resulting product resists delamination. For various applications of the paper product, it may be desirable to increase the barrier properties or hold out properties. In the case of tape such as masking tape, it is generally desirable that paint, stain, or varnish does not penetrate through the masking tape and discolor the surface beneath the masking tape. Accordingly, a web of fibers may be treated with a latex to increase hold out. In addition, the hold out may be designed for water hold out, organic solvent hold out, or combination of both. The latex treatment may be provided to enhance the stretch of the web of fibers. By applying the latex so that it enters into the web of fibers rather than resting on top of the web of fibers as a coating, it may be possible to help adhere the fibers together to improve the stretch of the web of fibers.

By way of example, suitable latexes include polyacrylates, styrene-butadiene copolymers, styrene-acrylic copolymers, ethylene-vinyl acetate copolymers, nitrile rubbers, polyvinyl chloride, polyvinyl acetate, ethylene-acrylate copolymers, and vinyl acetate-acrylate copolymers. Examples of polyacrylates include those sold under the trade names HYCAR® and CARBOSET® available from B.F. Goodrich Company, Cleveland, Ohio, and RHOPLEX® available from Rohm and Haas Company, Philadelphia Pa. Examples of styrene-butadiene copolymers include those sold under the trade names BUTOFAN® available from BASF Corporation, Ontario Canada and DL-219 and DL-283 available from Dow Chemical Company, Midland, Mich. Examples of ethylene-vinyl acetate copolymers include those sold under the trade name DUR-O-SET® available from National Starch and Chemical Co., Bridgewater, N.J. Examples of nitrile rubbers include those sold under the trade name HYCAR® available from B.F. Goodrich Company, Cleveland, Ohio. Examples of polyvinyl chlorides include those sold under the trade name GEON® available from B.F. Goodrich Company, Cleveland, Ohio. Examples of polyvinyl chlorides include those sold under the trade name VINAC® available from Air Products and Chemicals, Inc., Naperville, Ill. Examples of ethylene-acrylate copolymers include those sold under the trade names MICHEM® PRIME available from Michelman, Inc., Cincinnati, Ohio, and ADCOTE® available from Morton Thiokol, Inc., Chicago, Ill. Examples of vinyl acetate-acrylate copolymers include those sold under the trade name XLINK® available from National Starch and Chemical Co., Bridgewater, N.J.

Web of Fibers

One of skill in the art will appreciate that the web of fibers can comprise many different types of fibers, both natural and synthetic. Natural fibers from plants can often be referred to as cellulosic fibers. Exemplary natural fibers that can be used include wood fibers and non-wood natural fibers such as vegetable fibers, cotton, various straws (wheat, rye, and others), various canes (bagasse and kenaf), grasses (bamboo, etc.), hemp, corn stalks, etc.

The pulp used for creating the web of fibers can include hardwood fibers, softwood fibers, or a blend of hardwood and softwood fibers. The pulp can be provided as cellulose fiber from chemical pulped wood, and can include a blend from coniferous and deciduous trees. By way of example, the fibers can be from northern hardwood, northern softwood, southern hardwood, or southern softwood. Hardwood fibers tend to be more brittle but are generally more cost effective for use because the yield for pulp from hardwood is higher than the yield for pulp from softwood. The pulp can contain about 0 to about 70% hardwood fibers. Softwood fibers have better paper making characteristics but are more expensive. The pulp can contain about 0 to about 100% softwood fibers. The pulp can contain a blend of hardwood and softwood fibers. In an embodiment, the pulp can contain greater than 70% natural fibers. In an embodiment, the pulp contains greater than 80% natural fibers. In an embodiment, the pulp can contain greater than 90% natural fibers. In an embodiment, the pulp can contain 97% natural fibers and 3% polyester fibers as measured by weight. In an embodiment, the pulp contains 97% northern softwood and 3% polyester fibers as measured by weight.

The natural fibers used in the invention can be extracted with various pulping techniques. For example, mechanical or high yield pulping can be used for stone groundwood, pressurized groundwood, refiner mechanical pulp, and thermomechanical pulp. Chemical pulping can be used incorporating kraft, sulfite, and soda processing. Semi-chemical and chemi-mechanical pulping can also be used which includes combinations of mechanical and chemical processes to produce chemi-thermomechanical pulp.

The fibers can also be bleached or unbleached. One of skill in the art will appreciate that the bleaching can be accomplished through many methods including the use of chlorine, hypochlorite, chlorine dioxide, oxygen, peroxide, ozone, or a caustic extraction.

The pulp can also include post-consumer waste (PCW) fiber. Post-consumer waste fiber is recovered from paper that is recycled after consumer use. Post-consumer waste fiber can include both natural and synthetic fiber. Incorporation of PCW fiber can aid in efficient use of resources and increase the satisfaction of the end user.

Refining is the treatment of pulp fibers to develop their papermaking properties. Refining increases the strength of fiber to fiber bonds by increasing the surface area of the fibers and making the fibers more pliable to conform around each other, which increases the bonding surface area and leads to a denser sheet, with fewer voids. Most strength properties of paper increase with pulp refining, since they rely on fiber to fiber bonding. The tear strength, which depends highly on the strength of the individual fibers, actually decreases with refining. Refining of pulp increases the fibers flexibility and leads to denser paper. This means bulk, opacity, and porosity decrease (densometer values increase) with refining. Fibrillation is a result of refining paper fibers. Fibrillation is the production of rough surfaces on fibers by mechanical and/or chemical action; refiners break the outer layer of fibers, i.e., the primary cell wall, causing the fibrils from the secondary cell wall to protrude from the fiber surfaces.

The extent to which a paper product is made with refined fibers can be measured by various techniques. One type of testing for refined fibers is referred to as freeness testing. In freeness testing, the speed water drains through a sample paper is measured. Because paper made with highly refined fibers has fewer voids and small holes, it takes water longer to drain through a sheet of paper made with highly refined fibers. A standard for freeness testing is the Canadian Standard Freeness (CSF) test. The CSF test was developed for use with groundwood pulps and was not intended for use with chemical pulps; nevertheless, it is the standard test for monitoring refining in North American mills. TAPPI (Technical Association of the Pulp and Paper Industry) standard test T 227 corresponds to the CSF test. Another common test of the refined nature of paper is the Shopper Riegler test, which is similar in concept to the CSF test.

The fibers can be refined so that the resulting paper (including synthetic fiber) provides the desired Canadian Standard Freeness value. In general, less refined paper has more holes and voids than a more refined paper. In the case of a masking tape product that is used to mask an area and reduce penetration of a component (e.g. paint) to the area surface, it may be desirable to provide a desired level of refining to reduce the presence of holes and voids. In addition, it is generally understood that a higher level of refining may have a tendency to decrease tear strength of the resulting paper product. Accordingly, the level of refining can be selected to provide the desired barrier and tear strength properties. The paper can be provided having a Canadian Standard Freeness value of greater than about 100 $cm^3$, and the paper can be provided having a Canadian Standard Freeness value of less than about 850 $cm^3$. In addition, the paper can be provided having a Canadian Standard Freeness value of about 200 $cm^3$ to about 700 $cm^3$, and can be provided having a Canadian Standard Freeness value of about 450 $cm^3$ to about 600 $cm^3$.

The basis weight of a paper product refers to the weight per unit area of the web of fibers with additives that may be introduced either or both wet end chemistry and size press chemistry, but before the introduction of latex treatment. In general, the basis weight can be selected to provide the crepe paper product having the desired properties for a particular application. In certain applications it may be desirable to provide a creped paper product from a heavier basis weight web of fibers compared with another application. In the case of masking tape, the basis weight of the web of fibers can be at least about 10 lbs./3000 $ft^2$ so that the tape can pull off the roll and be applied without tearing as a result of hand manipulation. Of course, the basis weight could be lower depending on the care the person is willing to exercise or the tolerance the person is willing to entertain relative to tearing of the tape. In general, it is expected that masking tape can be prepared from a web of fibers having a basis weight of about 15 lbs./3000 $ft^2$ to about 40 lbs./3000 $ft^2$, and can have a basis weight of about 20 lbs./3000 $ft^2$ to about 35 lbs./3000 $ft^2$. For other products such as carpet seaming tape, it may be desirable to provide the creped paper product from a web of fibers having a basis weight of up to about 90 lbs./3000 $ft^2$. Accordingly, a general range for selecting the basis weight of the web of fibers is about 10 lbs./3000 $ft^2$ to about 90 lbs./3000 $ft^2$. The finished creped paper product refers to the creped web of fibers with additives from both wet end chemistry and size press chemistry but before latex treatment. In general, any weight of paper may be used in accordance with the present invention. Therefore, the finished creped paper product is made in weights desired by end users. However, using a paper substrate that is heavier than necessary for a particular application may not be economically efficient. In an embodiment, the finished creped paper product can include less than about 35.0 lbs./3000 $ft^2$ of paper. Paper that is too low in weight may not be suitable for use as tape. In an embodiment, the finished creped paper product can have greater than about 18.0 lbs./3000 $ft^2$ of paper. The finished creped paper product of the invention can be in the range of about 20.0 to 25.0 lbs./3000 $ft^2$ of paper.

The present invention may be better understood with reference to the following example. This example is intended to be representative of specific embodiments of the invention, and is not intended as limiting the scope of the invention.

EXAMPLE

Effect of Synthetic Fiber Amounts on Dry Tear Strength

Creped paper products were made by combining various percentages of polyester fiber with natural fibers and following the process described with respect to FIG. 1. The polyester fibers used can be characterized as high tenacity, 3 denier filament, 0.25 inch length fibers from Minifiber, Inc. Some of the creped paper products were impregnated with ACRONAL S 504 (an aqueous styrene/acrylic copolymer latex) available from BASF Corporation, Ontario Canada. After the creped paper products were manufactured, their dry tear strength was tested with a ProTear Electronic Elmendorf Tearing Tester, Model 60-2200, from Thwing-Albert Instrument Company. The dry tear strength was measured in accordance with TAPPI Standard T414. The results are shown in Table 1.

TABLE 1

| | Percentage of Synthetic Fibers | CD Tear Strength (gf) | MD Tear Strength (gf) |
|---|---|---|---|
| No Latex | 0.0 | 73.3 | 53.2 |
| | 3.0 | 80.9 | 65.5 |
| Latex Impregnated | 0.0 | 39.2 | 29.3 |
| | 3.0 | 49.6 | 41.95 |

The results show that inclusion of 3.0% synthetic fibers increased dry tear strength for a creped paper product that has not been impregnated with latex by approximately 10.3% in the cross direction and about 23.1% in the machine direction. The results show that inclusion of 3.0% synthetic fibers increased dry tear strength for a latex impregnated creped paper substrate by approximately 26.5% in the cross direction and approximately 43.2% in the machine direction.

The above specification provides a complete description of the manufacture and use of the composition of the invention. Since many embodiments of the invention can be made without departing from the spirit and scope of the invention, the invention resides in the claims hereinafter appended.

We claim:

1. A creped paper product comprising:

a creped paper substrate comprising a web of fibers comprising about 2 wt. % to about 5 wt. % polyester fibers based on the total weight of the fibers and about 90 wt. % to about 99.5 wt. % cellulosic fibers based on the total weight of the fibers, the creped paper substrate having a stretch of at least 3% in the machine direction according to TAPPI test T494 and a dry tear strength in the machine direction according to TAPPI test T494 at least 30% greater than an otherwise identical creped paper substrate that does not contain the polyester fibers, wherein the creped paper substrate is creped as a result of creping using a creping blade, and wherein the creped paper substrate has been treated with a latex composition so that the latex composition enters into the web of fibers;

a release layer provided on a first surface of the creped paper substrate;

adhesive provided on a second surface of the creped paper substrate; and wherein the creped paper product is provided in the form of a roll.

2. A creped paper product of claim 1, wherein the creped paper product has a dry tear strength in the machine direction according to TAPPI test T414 at least 20% greater than an otherwise identical creped paper product that does not contain the polyester fibers.

3. A creped paper product according to claim 1, wherein the creped paper product has a dry tear strength in the cross direction according to TAPPI test T414 at least 5% greater than an otherwise identical creped paper product that does not contain the polyester fibers.

4. A creped paper product of claim 1, wherein the polyester fibers have an average length of about 1 mm to about 100 mm.

5. A creped paper product of claim 1, wherein the polyester fibers have an average length of about 1 mm to about 8 mm.

6. A creped paper product of claim 1, wherein the web of fibers has a weight of about 10 lbs./3,000 $ft^2$ to 90 lbs./3,000 $ft^2$.

7. A creped paper product of claim 1, wherein the web of fibers has a Canadian Standard Freeness value of between about 100 $cm^3$ and 850 $cm^3$ according to TAPPI test T 227.

8. A creped paper product of claim 1, comprising about 5 to about 100 crepe lines per lineal inch.

9. A creped paper product of claim 1, comprising about 20 to about 30 crepe lines per lineal inch.

10. A creped paper product according to claim 1, wherein the creped paper product comprises greater than 100 to about 200 crepe lines per lineal inch.

11. A creped paper product according to claim 1, wherein the creped paper substrate is impregnated with the latex composition.

12. A method for forming a creped paper product comprising:

creping a web of fibers comprising about 2 wt. % to about 5 wt. % polyester fibers based on the total weight of the fibers and about 90 wt. % to about 99.5 wt. % cellulosic fibers based on the total weight of the fibers to provide a creped paper substrate having a stretch of at least 3% in the machine direction according to TAPPI test T494 and a dry tear strength in the machine direction according to TAPPI test T494 at least 30% greater than an otherwise identical creped paper substrate that does not contain the polyester fibers, wherein creping comprises creping using a creping blade;

treating the creped paper substrate with a latex composition so that the latex composition enters into the web of fibers;

providing a release layer on a first surface of the creped paper substrate;

providing an adhesive on a second surface of the creped paper substrate; and rolling the creped paper product into the form of a roll.

13. A method according to claim 12, wherein the creped paper product has a dry tear strength in the machine direction according to TAPPI test T414 at least 20% greater than an otherwise identical creped paper product that does not contain the polyester fibers.

14. A method according to claim 12, wherein the creped paper product has a dry tear strength in the cross direction according to TAPPI test T414 at least 5% greater than an otherwise identical creped paper product that does not contain the polyester fibers.

15. A method according to claim 12, wherein the polyester fibers have an average length of about 1 mm to about 100 mm.

16. A method according to claim 12, wherein the polyester fibers have an average length of about 1 mm to about 8 mm.

17. A method according to claim 12, wherein the web of fibers has a weight of about 10 lbs./3,000 $ft.^2$ to 90 lbs./3,000 $ft.^2$

18. A method according to claim 12, wherein the web of fibers has a Canadian Standard Freeness value of between about 100 $cm^3$ and 850 $cm^3$ according to TAPPI test T 227.

19. A method according to claim 12, comprising about 5 to about 100 crepe lines per lineal inch.

20. A method according to claim 12, comprising about 20 to about 30 crepe lines per lineal inch.

21. A method according to claim 5, wherein the creped paper product comprises greater than 100 to about 200 crepe lines per lineal inch.

22. A method according to claim 12, wherein the creped paper substrate is impregnated with the latex composition.

* * * * *